US007124665B1

(12) United States Patent
Chen

(10) Patent No.: US 7,124,665 B1
(45) Date of Patent: Oct. 24, 2006

(54) SCREW POSITIONING DEVICE FOR A SCREWDRIVER

(76) Inventor: Hsiu-E Chen, No. 238, Minsheng Rd., Daliao Township, Kaohsiung County 831 (TW)

( * ) Notice: Subject to any disclaimer, the term of this patent is extended or adjusted under 35 U.S.C. 154(b) by 0 days.

(21) Appl. No.: 11/234,936

(22) Filed: Sep. 26, 2005

(51) Int. Cl.
*B25B 23/08* (2006.01)
*B25B 23/10* (2006.01)

(52) U.S. Cl. ..... 81/451; 81/439; 81/460; 81/461

(58) Field of Classification Search ..... 81/439, 81/460, 461, 451
See application file for complete search history.

(56) References Cited

U.S. PATENT DOCUMENTS 5,724,873 A * 3/1998 Hillinger ..... 81/451
5,996,452 A * 12/1999 Chiang ..... 81/429
6,138,538 A * 10/2000 Neijndorff ..... 81/451
6,148,699 A * 11/2000 Han ..... 81/451
6,666,114 B1 * 12/2003 Lin ..... 81/438
6,931,967 B1 * 8/2005 Chang ..... 81/451

* cited by examiner

*Primary Examiner*—Joseph J. Hail, III
*Assistant Examiner*—Shantese L. McDonald
(74) *Attorney, Agent, or Firm*—Charles E. Baxley

(57) ABSTRACT

A screw positioning device for a screwdriver comprises a connecting rod assembly, a screw positioning sleeve and a magnetic member. The screw positioning sleeve is axially defined with a slide hole for insertion of an end of the connecting rod assembly, the magnetic member is installed on inner peripheral surface of a front end of the screw positioning sleeve, the screw positioning sleeve is axially positioned at the end of the connecting rod assembly, and the positioning sleeve can move back and forth a predetermined distance with respective to the connecting rod assembly.

4 Claims, 7 Drawing Sheets

SCREW POSITIONING DEVICE FOR A SCREWDRIVER

BACKGROUND OF THE INVENTION

1. Field of the Invention

The present invention relates to a screw positioning device for a screwdriver, and more particularly to a screw positioning device for a screwdriver that can be assembled and disassembled easily.

2. Description of the Prior Art

An automatic screw driving device is always provided with a connecting tube for connecting a screwdriver head to the screwdriving device, and this connecting tube normally has a screw positioning device for attracting and holding the screw to be driven. With reference to FIG. 1, a conventional screwdriver head connecting tube disclosed by TW Patent No. 94,103,623 is shown and comprises a connecting rod 11, a slide sleeve 12, a spring 13, a retaining ring 14 and a magnetic member 15. The connecting rod 11 is defined with a socket at either end thereof for insertion of the inserting rod 111 and a screwdriver head 112. The slide sleeve 12 is slidably mounted on the connecting rod 11. The spring 13 is installed on the connecting rod 11 and biased between the shoulder of the connecting rod 11 and the slide sleeve 12. The retaining ring 14 is installed on the connecting rod 11. The magnetic member 15 is fixed at an end of the slide sleeve 12 for retaining the fasteners (such as screw) to the screwdriver head 112 and has a hole for passage of the screwdriver head 112.

However, this conventional connecting tube still has the following shortcomings:

Firstly, the structure of the connecting tube is too complicated and its cost is high.

Secondly, the magnetic device for holding the screw of this conventional connecting tube only can be used on such a tool that comprises the inserting rod 111 and the rod 11, so it is too limited in applicability.

The present invention has arisen to mitigate and/or obviate the afore-described disadvantages of the screw positioning device for a screwdriver.

SUMMARY OF THE INVENTION

The primary objective of the present invention is to provide a simple structured screw positioning device for a screwdriver, the screw positioning device has a screw positioning sleeve that can be replaced very easily, wherein a connecting rod assembly is inserted in a slide hole of the screw positioning sleeve, a magnetic member is disposed on the inner surface of an end of the screw positioning sleeve, and the screw positioning sleeve is movably confined within an annular positioning groove at the end of the connecting rod assembly.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
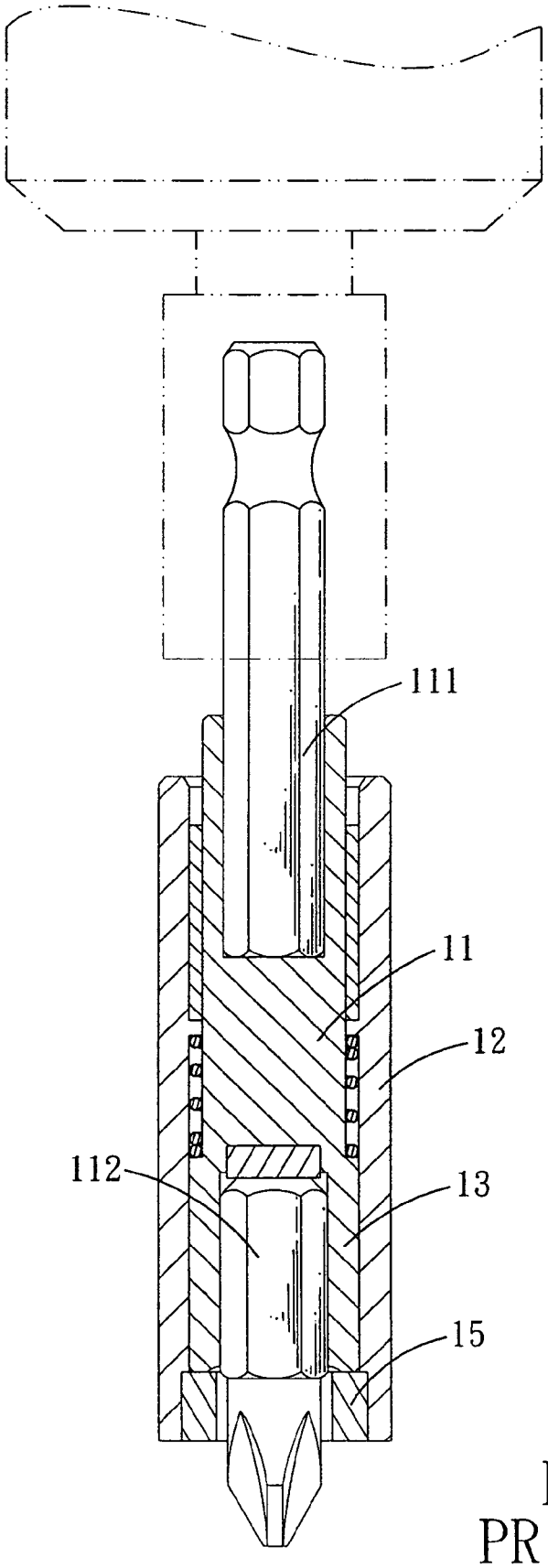
FIG. 1 PRIOR ART
FIG. 1 is a cross sectional view of a conventional screw positioning device for a screwdriver.
Figure 2:
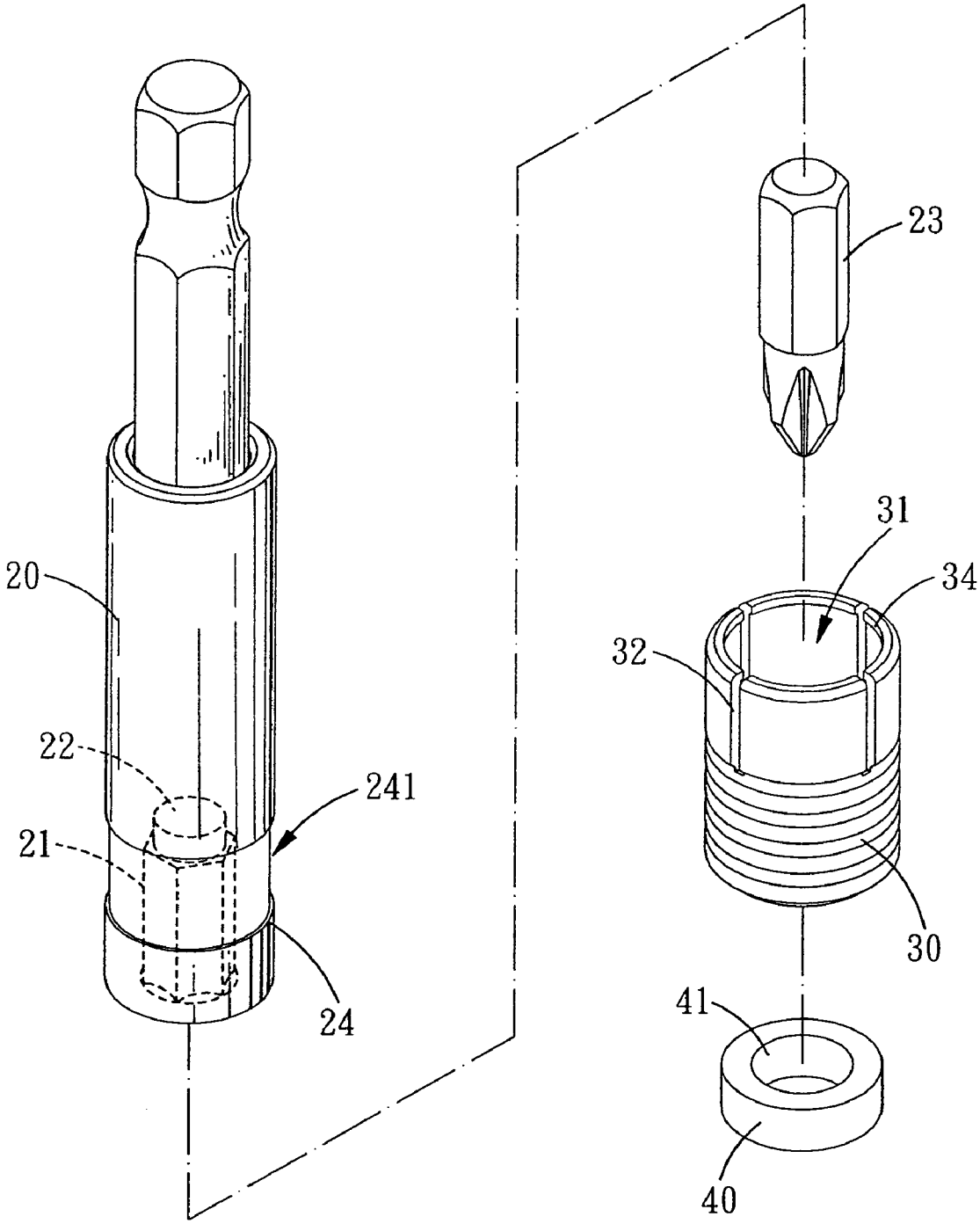
FIG. 2 is an exploded view of a screw positioning device for a screwdriver in accordance with a first preferred embodiment of the present invention.
Figure 3:
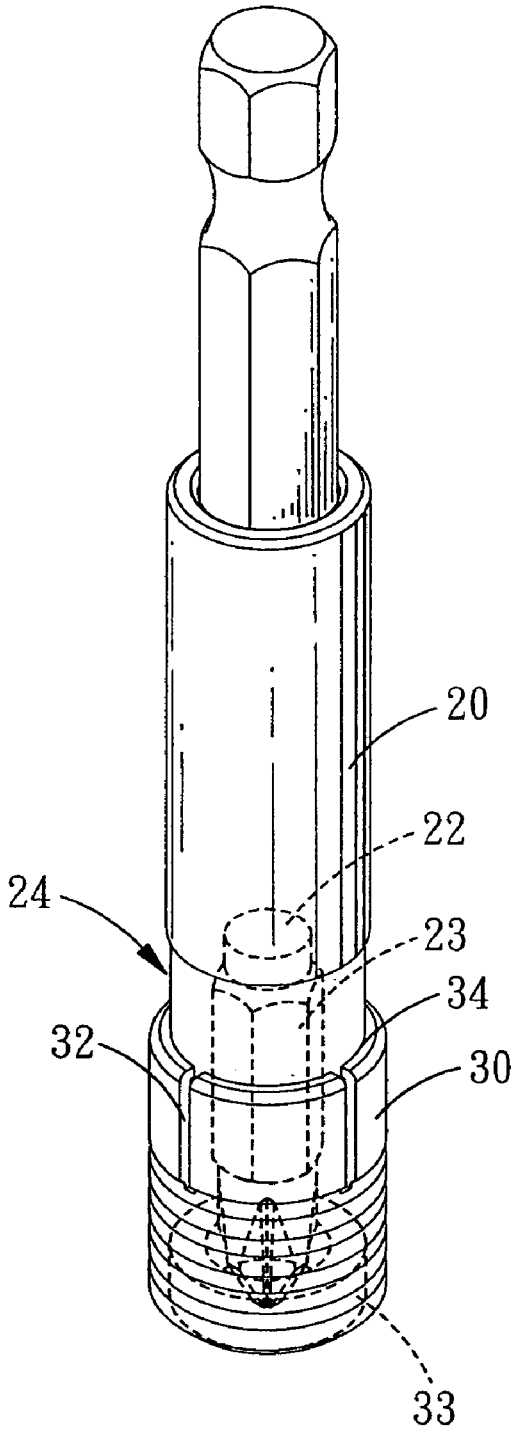
FIG. 3 is a perspective view of the screw positioning device for a screwdriver in accordance with the first preferred embodiment of the present invention.
Figure 4:
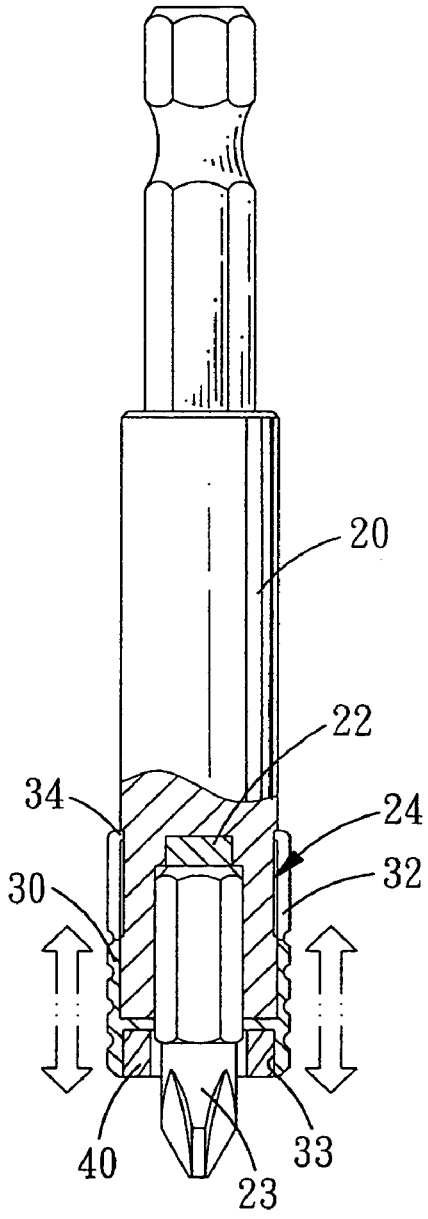
FIG. 4 is an assembly cross sectional view of the screw positioning device for a screwdriver in accordance with the first preferred embodiment of the present invention.

Referring to FIGS. 2–3, a screw positioning device for a screwdriver in accordance with a first preferred embodiment of the present invention is shown and comprises a connecting rod assembly 20, a screw positioning sleeve 30 and a magnetic member 40.

The connecting rod assembly 20 is disposed at the front end of a power tool or a hand tool, in an end of the connecting rod assembly 20 is formed a hexagonal cavity 21 in which is deposed a magnet 22 and then inserted a metal screwdriver head 23, so that the metal screwdriver head 23 is attracted by the magnet 22. In the outer surface of the connecting rod assembly 20 is formed an annular positioning groove 24 that has a predetermined width 241 and is aligned to the hexagonal cavity 21.

The screw positioning sleeve 30 is an tubular member axially defined with a slide hole 31, in the outer surface of a rear end of the screw positioning sleeve 30 are formed a plurality of elongated slots 32 for allowing deformation of the screw positioning sleeve 30. Still at this end of the screw positioning sleeve 30 are formed a plurality of positioning protrusions 34 that are formed in the shape of the positioning groove 24 in the outer surface of the connecting rod assembly 20. In the inner surface of a front end of the screw positioning sleeve 30 is formed an annular groove 33. The end of the connecting rod assembly 20 having the screw driver 23 is inserted in the slide hole 31 of the screw positioning sleeve 30 in such a manner that the positioning protrusions 34 of the screw positioning sleeve 30 are slidably disposed in the positioning groove 24 of the connecting rod assembly 20 and the motion of the positioning protrusions 34 are restricted within the width 241 of the positioning groove 24.

The magnetic member 40 is a ring-like structure having a central hole 41 for passage of the screwdriver head 23 of the connecting rod assembly 20 and is installed in the annular groove 33 of the screw positioning sleeve 30. The magnetic member 40 and the magnet 22 of the connecting rod assembly 20 are placed in a north-to-north and south-to-south manner that they repel each other.

Figure 5:
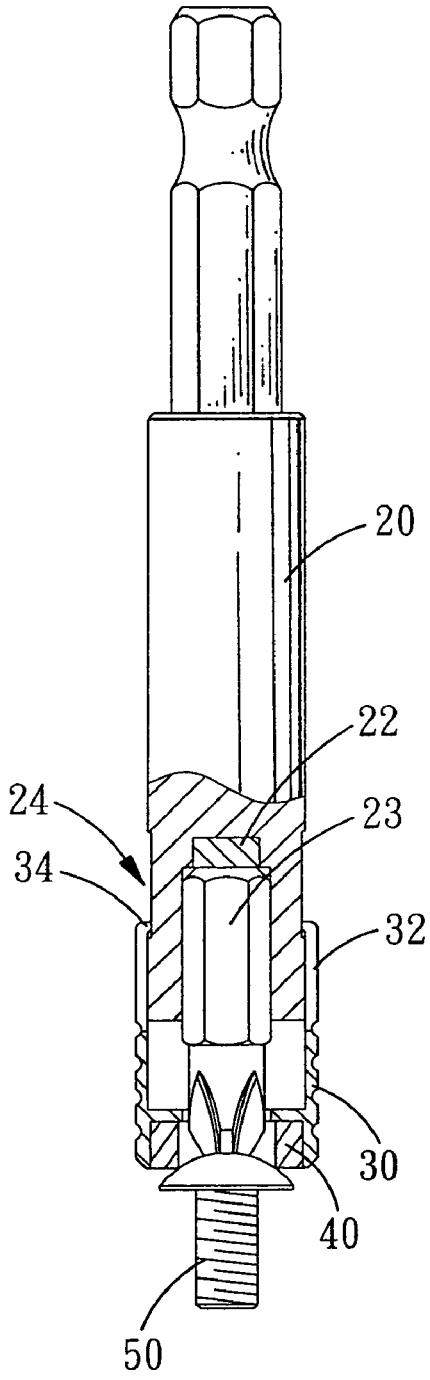
FIG. 5 is an operational cross sectional view of the screw positioning device for a screwdriver in accordance with the first preferred embodiment of the present invention.

For a better understanding of the present invention, its operation and function, reference should be made to FIG. 5, before the connecting rod assembly 20 is rotated by the power tool, and because the magnetic member 40 and the magnet 22 are placed in such a manner that they repel each other, so that, when the screwdriver is not in use, the screw positioning sleeve 30 is kept at the utmost front end screwdriver under the effect of the magnetic force thereof (the screwdriver head 23 of the connecting rod assembly 20 stays in the slide hole 31 of the screw positioning sleeve 30). At this moment, the screw positioning sleeve 30 can protect the screwdriver head 23 from damage.

When the screwdriver is in use, the connecting rod assembly 20 is driven by the screwdriver to rotate a screw, and the screw positioning sleeve 30 is kept at the utmost front end screwdriver under the effect of the magnetic force thereof, so that the metal screw 50 can be attracted by the magnetic member 40 and held at the front end of the screw positioning sleeve 30 easily. Meanwhile, the screwdriver head 23 will be pushed out of the slide hole 31 of the screw positioning sleeve 30. During the process of rotating the screw 50, the magnetic member 40 will keep attracting the screw 50, and the screw positioning sleeve 30 can move back and forth in response to the force applied by the user, so as to make the screw positioning sleeve 30 move with the motion of the screw 50. Therefore, the screw 50 will not disengage from the screwdriver head during the process of rotating the screw.

On the other hand, due to the positioning protrusions 34 of the screw positioning sleeve 30 is slidably kept in the positioning groove 24 of the connecting rod assembly 20, plus, in the outer surface of an end of the screw positioning sleeve 30 are formed a plurality of elongated slots 32 for improving the elastic deformation ability thereof, accordingly the screw positioning sleeve 30 can be pushed onto and pulled out of the connecting rod assembly 20 easily.

Figure 6:
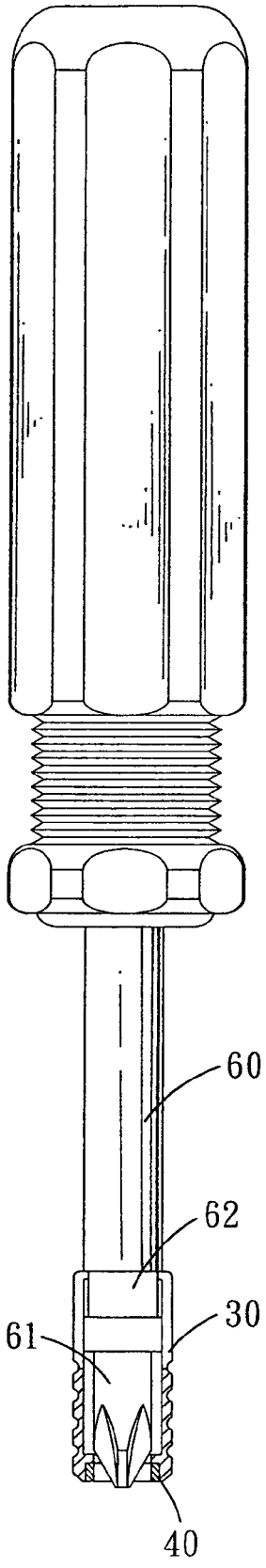
FIG. 6 is a cross sectional view of a screw positioning device for a screwdriver in accordance with a second preferred embodiment of the present invention.

Referring then to FIG. 6, a screw positioning device for a screwdriver in accordance with a second preferred embodiment of the present invention is shown, in which, the connecting rod assembly can be a rod 60 of a hand driven screwdriver. In the outer surface of the front end of the screwdriver head 61 of the rod 60 is formed a positioning groove 62 within which the screw positioning sleeve 30 can be confined. Metal screw also can be attracted and held by the magnetic member 40 of the screw positioning sleeve 30, generally, the screw positioning device of this embodiment is identical to that of the first embodiment.

Figure 7:
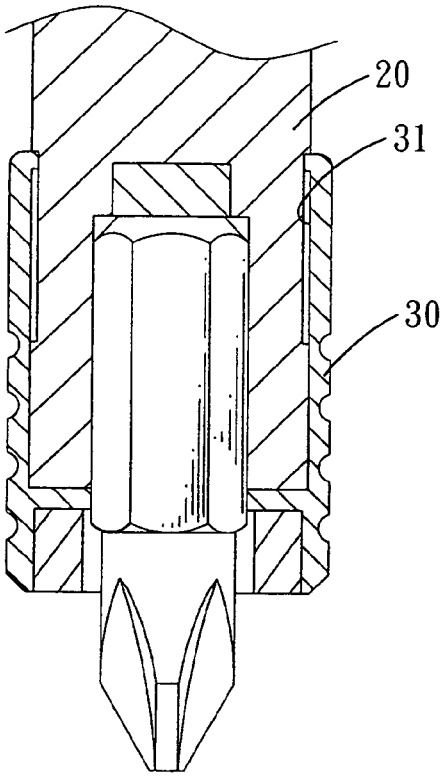
FIG. 7 is a cross sectional view of a screw positioning device for a screwdriver in accordance with a third preferred embodiment of the present invention.

Referring to FIG. 7, a screw positioning device for a screwdriver in accordance with a third preferred embodiment of the present invention is shown, wherein the screw positioning sleeve 30 is made of flexible material (such as plastic), therefore, it is unnecessary to define elongated slot in the outer surface of the screw positioning sleeve for improving the deformation ability thereof, and the screw positioning sleeve 30 also can be can be pushed onto and pulled out of the rod 60 easily.

Figure 8:
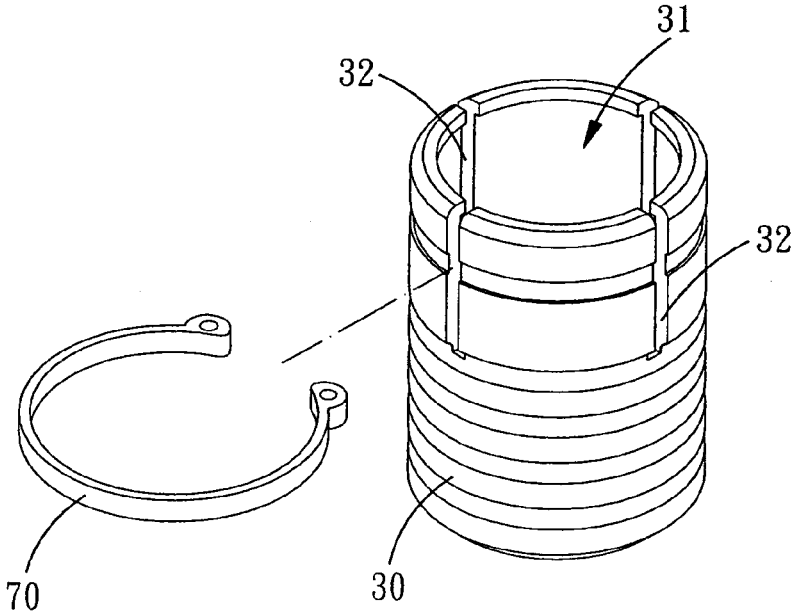
FIG. 8 shows a screw positioning device for a screwdriver in accordance with a forth preferred embodiment of the present invention.

Referring to FIG. 8, a screw positioning device for a screwdriver in accordance with a fourth preferred embodiment of the present invention is shown, wherein a plurality of elongated slots 32 for allowing deformation of the screw positioning sleeve 30 are formed in the outer surface of an end of the screw positioning sleeve 30. However, if the positioning sleeve 30 is made of metal or other materials that are susceptible to deformation, frequent assembly and disassembly will cause permanent deformation of the end of the screw positioning sleeve 30 and will cause undesirable disengagement of the screw positioning sleeve 30 out of the screwdriver. Therefore, a C-shaped retainer 70 is mounted on the outer periphery of the screw positioning sleeve 30 and located outside the respective elongated slots for prevention of an overly deformation of the screw positioning sleeve 30.

Figure 9:
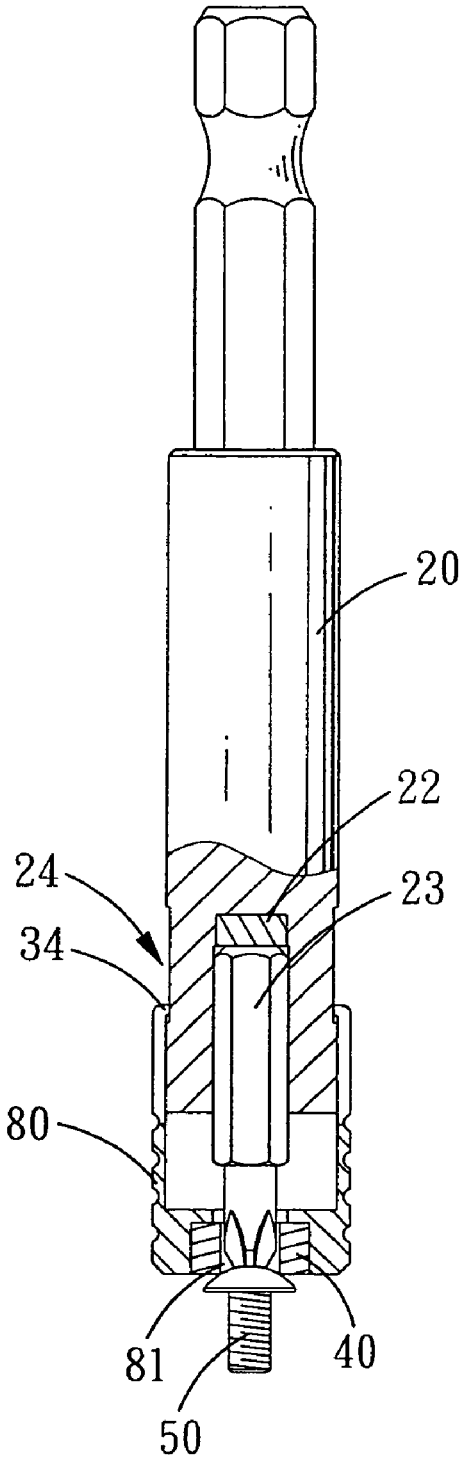
FIG. 9 is a cross sectional view of a screw positioning device for a screwdriver in accordance with a fifth preferred embodiment of the present invention.

Referring to FIG. 9, a screw positioning device for a screwdriver in accordance with a fifth preferred embodiment of the present invention is shown. Since the screw positioning sleeve 30 can be pushed onto or pulled out of the front end of the connecting rod assembly 20 directly, the screw positioning sleeve 30 can be replaced with a smaller screw positioning sleeve 80 at any time when a smaller screwdriver head 23 is used to rotate a smaller metal screw 50. The smaller screw positioning sleeve 80 has a smaller slide hole 81 and a smaller magnetic member 40.

While we have shown and described various embodiments in accordance with the present invention, it should be clear to those skilled in the art that further embodiments may be made without departing from the scope of the present invention.

What is claimed is:

1. A screw positioning device for a screwdriver comprising a connecting rod assembly, a screw positioning sleeve and a magnetic member;

wherein the screw positioning sleeve is axially defined with a slide hole for insertion of an end of the connecting rod assembly, the magnetic member is installed on inner peripheral surface of a front end of the screw positioning sleeve, the screw positioning sleeve is axially positioned at the end of the connecting rod assembly, and the positioning sleeve can move back and forth a predetermined distance with respective to the connecting rod assembly;

the connecting rod assembly is located at a front end of a power tool or a hand tool, in an outer surface of the connecting rod assembly is formed an annular positioning groove with a predetermined width;

at a rear end of the screw positioning sleeve are formed a plurality of positioning protrusions that are formed in a shape of the positioning groove in the outer surface of the connecting rod assembly, in the inner peripheral surface of the front end of the screw positioning sleeve is formed an annular groove, the connecting rod assembly is inserted in the slide hole of the screw positioning sleeve in such a manner that the protrusions of the screw positioning sleeve are slidably received in the annular positioning groove of the connecting rod assembly, and the screw positioning sleeve is movably confined within a scope of the width of the annular positioning groove;

the magnetic member is received in the annular groove in the inner peripheral surface of the front end of the screw positioning sleeve;

the screw positioning sleeve is a tubular structure, and in the outer surface of the rear end of the screw positioning sleeve are formed a plurality of elongated slots for allowing deformation of the screw positioning sleeve.

2. The screw positioning device for a screwdriver as claimed in claim 1, wherein a cavity is formed in the end of the connecting rod assembly, in which is received a magnet and then is inserted a screwdriver head, so that the metal screwdriver head is attracted by the magnet; and the magnetic member and the magnet of the connecting rod assembly are placed in such a manner that they repel each other;

the screw positioning sleeve is a tubular structure, and in the outer surface of the rear end of the screw position ing sleeve are formed a plurality of elongated slots for allowing deformation of the screw positioning sleeve.

3. The screw positioning device for a screwdriver as claimed in claim 2, wherein the screw positioning sleeve is a tubular structure, in the outer surface of the rear end of the screw positioning sleeve are formed a plurality of elongated slots for allowing deformation of the screw positioning sleeve, and a C-shaped retainer is mounted on the outer periphery of the screw positioning sleeve and located outside the respective elongated slots for prevention of an overly deformation of the screw positioning sleeve.

4. The screw positioning device for a screwdriver as claimed in claim 1, wherein the screw positioning sleeve is a tubular structure, in the outer surface of the rear end of the screw positioning sleeve are formed a plurality of elongated slots for allowing deformation of the screw positioning sleeve, and a C-shaped retainer is mounted on the outer periphery of the screw positioning sleeve and located outside the respective elongated slots for prevention of an overly deformation of the screw positioning sleeve.

* * * * *